US006079851A

United States Patent [19]

Altman et al.

[11] Patent Number: 6,079,851

[45] Date of Patent: Jun. 27, 2000

[54] FLUORESCENT LIGHTING FIXTURE HAVING TWO SEPARATE END SUPPORTS, SEPARATE INTEGRAL BALLAST SUBASSEMBLY AND LAMPS SOCKETS, AND HOOD POSITIONABLE ABOVE END SUPPORTS FOR MOUNTING IN OR BELOW OPENING IN SUSPENDED CEILING

[75] Inventors: Barry Altman, Mechanicsburg, Pa.; John Francis Turner, Clemmons; Robert Wayland Pitts, Winston-Salem, both of N.C.

[73] Assignee: The Whitaker Corporation, Wilmington, Del.

[21] Appl. No.: 08/806,497

[22] Filed: Feb. 26, 1997

[51] Int. Cl.[7] ..... F21K 27/00

[52] U.S. Cl. ..... 362/260; 362/220; 362/221; 362/225; 362/217; 362/364; 362/365; 362/404

[58] Field of Search ..... 362/260, 220, 362/221, 225, 217, 364, 365, 404

[56] References Cited

U.S. PATENT DOCUMENTS

| | | | |
|---|---|---|---|
| 4,363,082 | 12/1982 | Roland | 362/148 |
| 4,407,011 | 9/1983 | Lahm | 362/150 |
| 4,652,983 | 3/1987 | Mytels | 362/220 |
| 4,799,134 | 1/1989 | Pinch et al. | 362/217 |
| 5,093,767 | 3/1992 | Burn | 362/217 |
| 5,161,878 | 11/1992 | Degelmann et al. | 362/150 |
| 5,313,375 | 5/1994 | Jones | 362/96 |
| 5,526,244 | 6/1996 | Bishop | 362/147 |
| 5,615,943 | 4/1997 | Coldren | 362/220 |
| 5,720,540 | 2/1998 | Crown et al. | 362/92 |
| 5,720,546 | 2/1998 | Correll, Jr. et al. | 362/221 |

*Primary Examiner*—Sandra O'Shea
*Assistant Examiner*—Ronald E. Delgizzi
*Attorney, Agent, or Firm*—Robert Kapalka

[57] ABSTRACT

A lighting fixture 12 for use with fluorescent lamps 2 can be mounted in an opening in a suspended ceiling 4 or it can be supported below a ceiling. An integral ballast subassembly 14 is mounted on one end of the lighting fixture 12 on a ballast end support 64. Commoning lamp sockets 62 are mounted on a separate end support 84 on the opposite end of the lighting fixture 12. A ballast capable of energizing fluorescent lamps 2 in series is used so that the ballast subassembly need not be connected directly to the commoning lamp sockets 62. The end supports 64 and 84 can be mounted on opposite ends of a suspended ceiling opening 10 and a thin bonnet or hood 98 can then be positioned above the end supports 64, 84 after the ballast subassembly 14 is mounted at one end. The ballast subassembly housing 16 includes two separate compartments, with the ballast circuitry being housed in one compartment 28 and with the power wiring being positioned in the other compartment 30.

22 Claims, 13 Drawing Sheets

FLUORESCENT LIGHTING FIXTURE HAVING TWO SEPARATE END SUPPORTS, SEPARATE INTEGRAL BALLAST SUBASSEMBLY AND LAMPS SOCKETS, AND HOOD POSITIONABLE ABOVE END SUPPORTS FOR MOUNTING IN OR BELOW OPENING IN SUSPENDED CEILING

FIELD OF THE INVENTION

This invention is related to lighting fixtures for use with fluorescent lamps and is especially related to fluorescent lighting fixtures that are used with suspended ceilings. Furthermore this invention is related to the use of an electronic ballast that can energize multiple fluorescent lamps connected in series and to mounting means for positioning this ballast and for simplifying assembly of such lighting fixtures.

BACKGROUND OF THE INVENTION

Conventional fluorescent lighting assemblies employ ballasts that are connected to opposite ends of fluorescent lamps. For preheat or rapid-start fluorescent lamps, the ballast is connected in series with the two pins and the filaments at opposite ends of the lamp when the starter switch is closed. When the starter switch is opened the ballast reactor produces a high voltage between filaments at opposite ends of the lamp striking an arc through the argon and mercury vapor in the lamp.

For an instant start fluorescent lamp, no starter switch is used. The circuit is arranged so that a high voltage will be impressed across the lamp when the lamp circuit is closed and the voltage across the lamp is reduced to its normal operating value as soon as conduction takes place and the lamp is started.

In each case the ballast is connected to the bases at both ends of the fluorescent lamp. At least one commercially available instant start ballast is capable of operating multiple lamps in which the ballast is connected only to the pins or electrodes on the ends of the multiple lamps. Interior pins on adjacent lamp bases are commoned. The MULTILITE MUL120 manufactured and sold by Electrofab, Ltd. is capable of energizing an eight foot instant start fluorescent lamp or two four foot instant start fluorescent lamps with adjacent pins on adjacent lamp bases commoned. However this ballast is used in conventional applications where the ballast is mounted between opposite ends of the lighting fixture.

For conventional ballasts used in overhead troffers or luminaires, the ballast or ballasts are mounted at the center of the troffer and attached to the top of the troffer. Wires extend from the ballast or ballasts to sockets located at opposite ends of the troffer. For a four lamp assembly, wires must be connected to sockets at both ends of the four lamps. When a defective ballast is replaced, often on a trial and error basis, these wires must be disconnected and reconnected. Installation and maintenance of conventional lighting assemblies is therefor time consuming and cost is added to the manufacture of the lighting assembly.

One approach to simplifying and therefore reducing the cost of ballast installation is disclosed in U.S. patent application Ser. No. 08/309,300 filed Sep. 20, 1994 (now U.S. Pat. No. 5,720,546), assigned to The Whitaker Corporation. An integral ballast that can be mounted at one end of a lighting assembly is disclosed in that application. However, a neutral wire must still be connected to the opposite end of the lighting assembly and this wiring must be completed during assembly of the lighting fixture.

U.S. Patent Application (Attorney's Docket No. 16834) entitled Fluorescent Lighting Assembly with Integral Ballast eliminates the need to wire sockets at both ends of a fluorescent lighting assembly to a ballast. The ballast subassemblies depicted as the preferred embodiment of that invention are however still intended to be used with standard troffers or pans that fill two panel sections of a standard suspended ceiling.

The large lighting troffers used with conventional suspended ceilings serve several purposes. They provide a mounting surface for the conventional ballast located along the top; ballast cover channels covering the ballasts can be mounted on the troffers; diffusers, lenses, louvers and baffels can be mounted on the troffers; and the troffers support lamp sockets and fluorescent lamps mounted therein. These sheet metal troffers also provide fire protection enclosure, electrical grounding and act as a heat sink for the ballasts and for the fluorescent lamps. However, these conventional troffers are quite large and bulky, making them difficult to install and costly to ship. For example, a standard troffer commonly used for four foot fluorescent lamps is approximately four feet long, two feet wide and four inches deep. Although these standard troffers are dimensioned to be supported by the T-bar frame of a conventional suspended ceiling, they are bulky and can require two installers to position the troffers in a suspended ceiling. To wire a fixture of this type, the power wiring and the flexible metal conduit must be attached to the troffer through an access opening normally before the troffer is installed. The wiring can then be connected to the ballast secured to the top of the troffer. The ballast can be attached to the troffer before it is mounted in the suspended ceiling, although this would add weight, further complicating installation of the troffer. Conventional ballasts could be attached to the top of the troffer after it is positioned in the suspended ceiling.

There have been several attempts to eliminate the relatively large and expensive fixtures, and troffers, that occupy one or more full panel openings in a suspended ceiling. U.S. Pat. No. 4,363,082 and U.S. Pat. No. 4,407,011 show lighting fixtures that are either mounted in narrower and therefore more numerous panels or fluorescent lighting fixtures that can be mounted in openings in larger frames that separate and support ceiling panels. However, neither of these approaches is suited for use with standard suspended ceilings that use T-Bars forming panel openings on a two foot by two foot matrix and provide openings of four feet by two feet for use with standard four foot fluorescent lamps.

One other fluorescent lighting approach attempts to simplify the lighting fixture by positioning a conventional ballast in a central housing and by cantilevering U-shaped fluorescent tubes from the central housing. U.S. Pat. No. 5,526,244, however, is intended for use in an overhead luminaire that is mounted below the ceiling.

SUMMARY OF THE INVENTION

The invention disclosed and claimed herein provides a simple, easily installed, lighting fixture that can be used with fluorescent lamps. In this lighting fixture an integral ballast subassembly is mounted adjacent one end on a surface, such as an opening in a suspended ceiling, and a separate socket subassembly is mounted at an opposite end. These two end subassemblies are separate and detached and are not part of a bulky common unit. The two end subassemblies can therefore be separately installed. A lightweight bonnet or hood is then inserted between these two end subassemblies and slipped down over the top. Fluorescent lamps can then be installed between the ballast and the socket subassembly and a light diffuser panel can be positioned beneath the lamps to enclose them. This configuration is most advantageously used with a ballast that is capable of energizing plural fluorescent lamps in series without the need for separate interconnections to the intermediate ends of the lamps. With a ballast of this type, there is no need for wires extending to both ends of the lighting fixture and a simple commoning socket subassembly can be used at the opposite end to connect two lamps in series.

One of the advantages of this invention is that it simplifies the construction and assembly of fluorescent lighting fixtures, especially those used in suspended ceilings. The components of the lighting assembly are smaller and less bulky and there is no need for a large bulky conventional troffer such as those used in conventional fluorescent lighting fixtures. A ballast subassembly, a commoning socket subassembly, any supports for the ballast or the commoning sockets, and a bonnet or hood can be simply and easily installed one at a time. This approach has a number of advantages. For example, these fixtures can be easily assembled by one installer. There is no need for a second installer to assist in positioning relatively bulky troffers on which conventional ballasts are mounted. This is an even greater advantage for installations, such as large retail establishments or factory installations, that have relatively high ceilings. An integral ballast subassembly can also be conveniently wired below the suspended ceiling before it is mounted on a support or directly on the T-bars of a conventional suspended ceiling. Such an integral ballast subassembly can include an integral wiring box that even further simplifies wiring. Since the ballast subassembly can be easily removed from the lighting fixture, maintenance is simplified. This simple installation approach also reduces any potential obstruction of or by HVAC ducts or other wiring above a suspended ceiling.

Not only is this lighting fixture more easily installed, but it can also be more easily shipped. Individual components are smaller and can be more efficiently packaged without the need for unused open space in shipping containers or packages. Since shipping costs can be based on volume, significant savings can be achieved by nesting the individual components. For example all of the bonnets or hoods that would be used for a single installation could be shipped in a single box that might be only slightly larger than a box needed to ship one conventional troffer.

Although this invention is specially adapted for installation in a conventional suspended ceiling, it is suitable for use in a fixture that could be mounted beneath a ceiling and either attached directly to the ceiling or suspended below the ceiling. Indeed some of the same parts, such as the ballast subassembly, the commoning sockets, and the bonnet or hood would be common to each of these fixtures. Representative embodiments of this invention are also suitable for use in different size installations. For example, end supports for mounting the ballast subassembly and the commoning socket subassembly can be adjustable. The same end supports can also be used with four foot fluorescent lamps and with two foot fluorescent lamps.

These and other objects and advantages of this invention can be achieved by this invention in the manner shown by the representative embodiments disclosed herein.

BRIEF DESCRIPTION OF THE DRAWINGS

FIG. 3 is a perspective view showing an integral ballast and an end support that can be used to mount the integral ballast in a suspended ceiling.

FIG. 13 is another alternate embodiment in which the fixture is suspended below a ceiling on chains.

DETAILED DESCRIPTION OF THE INVENTION

Figure 1:
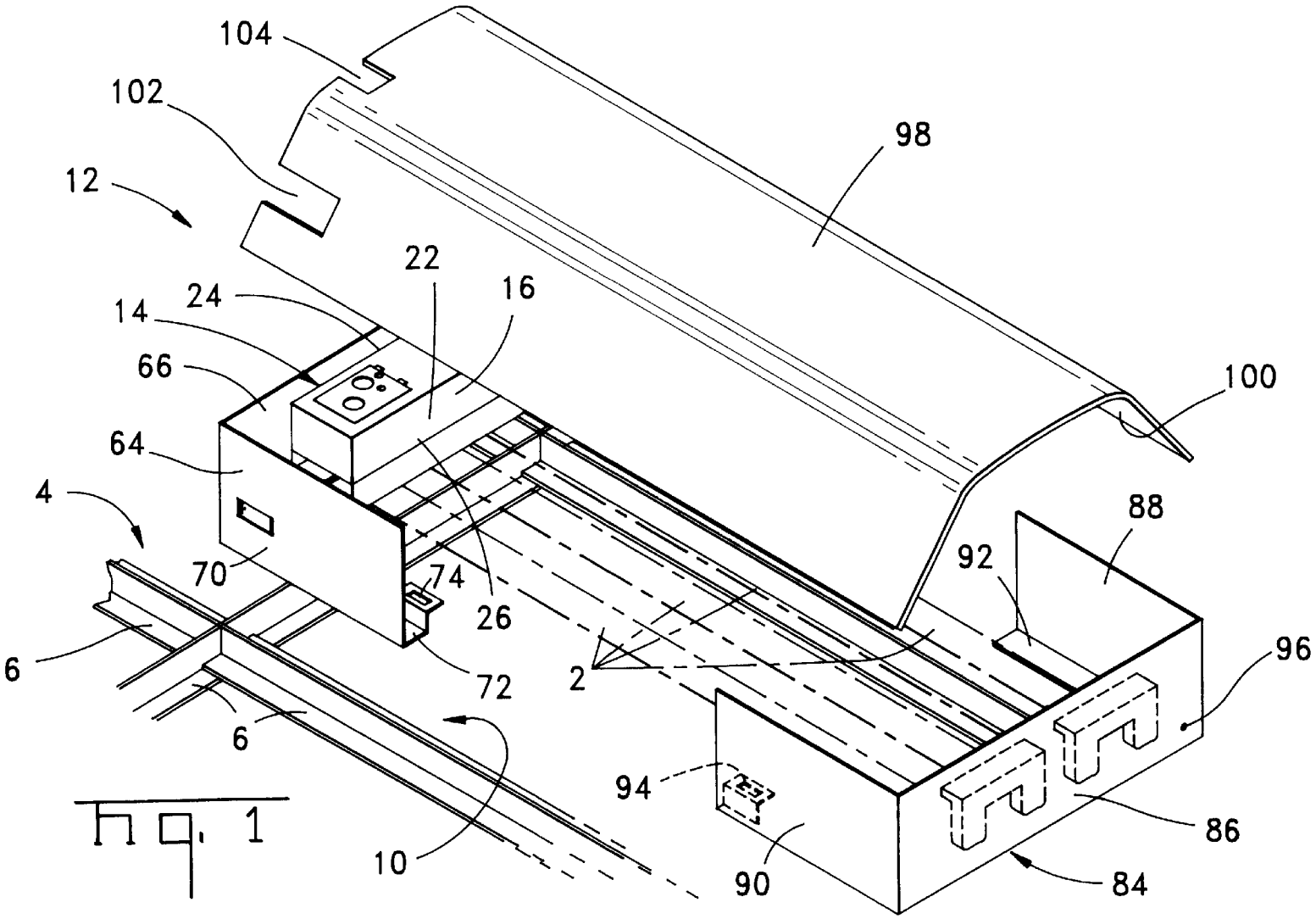
FIG. 1 is an exploded perspective view of a fluorescent lighting fixture as it would be used to mount four fluorescent tubes in an opening in a suspended ceiling.

Fluorescent lighting and suspended ceilings are commonly used in office buildings, other commercial installations and to a lesser extend in residential applications. Typically fluorescent lamps 2 are recessed in lighting fixtures that are positioned at regular intervals in a suspended ceiling 4. These suspended ceilings use a framework or matrix of T-bars 6 that are in turn suspended from load bearing members. The rectangular spaces formed by the matrix of T-bars 6 are then filled by acoustical ceiling tile or by HVAC vents or by lighting fixtures, particularly by fluorescent lighting fixtures that use tubular fluorescent lamps 2, such as standard instant start T-8 lamps. In a typical installation four fluorescent lamps 2, each having a length of four feet, could be positioned in a single opening 10 in a suspended ceiling 4 and adjacent openings 10 could be spaced apart by an interval of six feet to provide adequate lighting for a typical office. Openings 10 can be regularly spaced in a regular pattern or they can be positioned in an irregular pattern to account for walls or special lighting needs.

Lighting fixture 12, which comprises the preferred embodiment of this invention, includes an integral ballast or ballast subassembly 14 that includes an electronic ballast that is mounted in an outer metal or electrically conductive housing 16. Housing 16 includes a housing body 26 and a housing base 46 that are secured together to form a generally rectangular housing 16. As shown in FIG. 1, this ballast subassembly is normally mounted along one edge of an opening 10 in suspended ceiling 4. Since the width of standard openings 10 is two feet, the length of the ballast housing between first and second opposite ends 18, 20 would normally be less than two feet, although in installations where two lighting fixtures 12 need not be mounted side by side, the ballast housing 16 could have a length of greater than two feet.

In the embodiment shown in FIG. 1, the ballast subassembly 14 is supported by a first end support 64. Although end support 64 is a separate member on which the ballast housing 16 is mounted, in other versions the end support or end mounting member could be an integral part of the ballast subassembly 14. End support 64 is a C-shaped sheet metal member that is dimensioned to be supported on the adjacent T-bars 6 which comprise a portion of the structure on which the lighting fixture 12 is to be mounted.

A second end support 84 is located on the opposite end of the lighting fixture 12 and of the opening 10. This second end support 84 also is a C-shaped sheet metal member configured to be supported by the suspended ceiling T-bars 6. A socket subassembly 60 comprising commoning lamp sockets 62 in the embodiment of FIG. 1 are mounted on second end support 84 in alignment with conventional lamp sockets 58 mounted on ballast housing 16 at the opposite end of opening 10.

First end support 64 and second end support 84 are separate members that are independently mounted on the T-bars 6. The end supports are not connected to each other and are configured so that each rests on horizontal surfaces of three intersecting T-bars 6. The sheet metal end supports 64, 84 are also commoned to the T-bars 6 by conventional clips (not shown) to provide a continuous electrical ground.

A bonnet, canopy, or hood 98 is positioned on the top of the lighting fixture assembly 12 shown in FIG. 1. This bonnet or hood 98 comprises a thin flexible member fabricated from a cellulose or paperlike material or a plastic or sheet metal or any of a number of other conventional materials. In the preferred embodiment, the bonnet 98 is a thin sheet metal member.

Bonnet 98 has a reflective inner surface 100 that faces down when the bonnet 98 is positioned on the top of the lighting fixture 12. The bonnet 98 is a lightweight member that can easily be installed by one person. Bonnet 98 is inserted through the opening 10 after the end supports 64, 84 are in place and after the ballast subassembly 14 has been mounted on end support 64 and wired to a source of electrical power. After bonnet 98 is inserted through the remaining opening it can be rotated and slipped into position where it engages the inner surface of the end supports 64, 84. The reflective inner surface 100 redirects the light downward to illuminate the intended area.

After the bonnet 98 has been installed, the tubular fluorescent lamps 2 can be installed into aligned sockets 58, 62. Either prior to installation of the fluorescent lamps 2 or thereafter, a diffuser panel 110 can be mounted on the bottom of the lighting fixture 12. The diffuser panel 110 shown in FIG. 5 and used in the embodiment of FIG. 1 is substantially conventional in construction and can be attached at opposite ends to end supports 64, 84. A translucent panel is positioned in a surrounding metal frame 112. Along one side of diffuser panel 110 pivoting pins 114 engage the end supports 64, 84 and conventional latches 116 are located along the opposite side to secure the diffuser panel 110 to the two end supports 64, 84. Diffuser panel 110 can then be rotated into an open position for servicing the lighting fixture 12 in a conventional manner.

Figure 2:
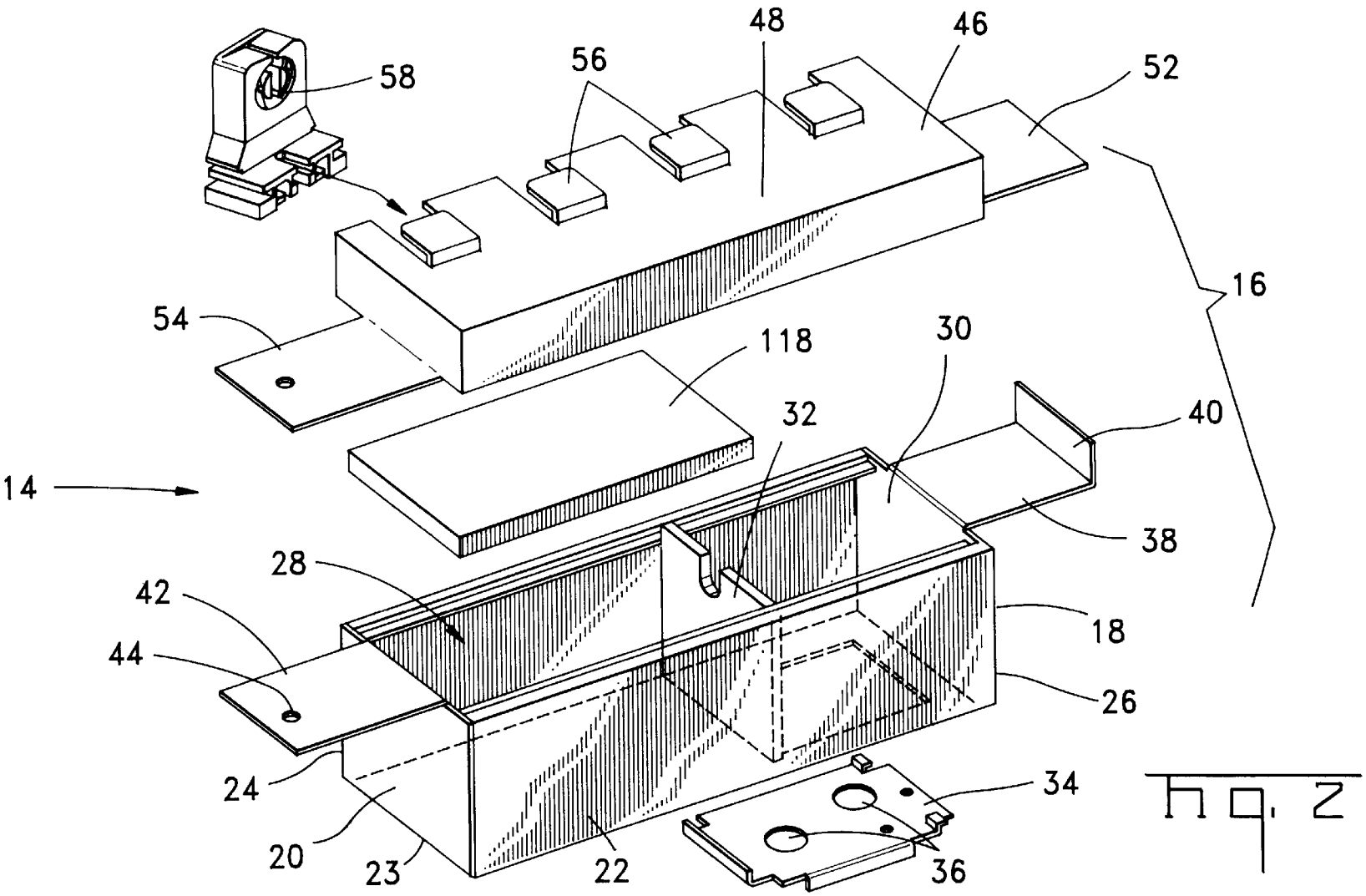
FIG. 2 is an exploded view showing the components of an integral ballast subassembly that can be used to energize multiple fluorescent lamps.

The preferred embodiment of the ballast subassembly 14 is shown in more detail in FIG. 2. The outer sheet metal ballast housing 16 is formed by a rectangular ballast housing body 26 and a mating rectangular ballast housing base 46. The housing 16 is generally rectangular in cross section between first and second end faces 18, 20. The inner and outer side faces 22, 24 extend between an outer face 23 that faces upward when the ballast subassembly 14 is mounted as part of the lighting fixture 12 as shown in FIG. 1 and an inner face 48 that faces downward and to which lamp sockets 58 are secured.

Figure 7:
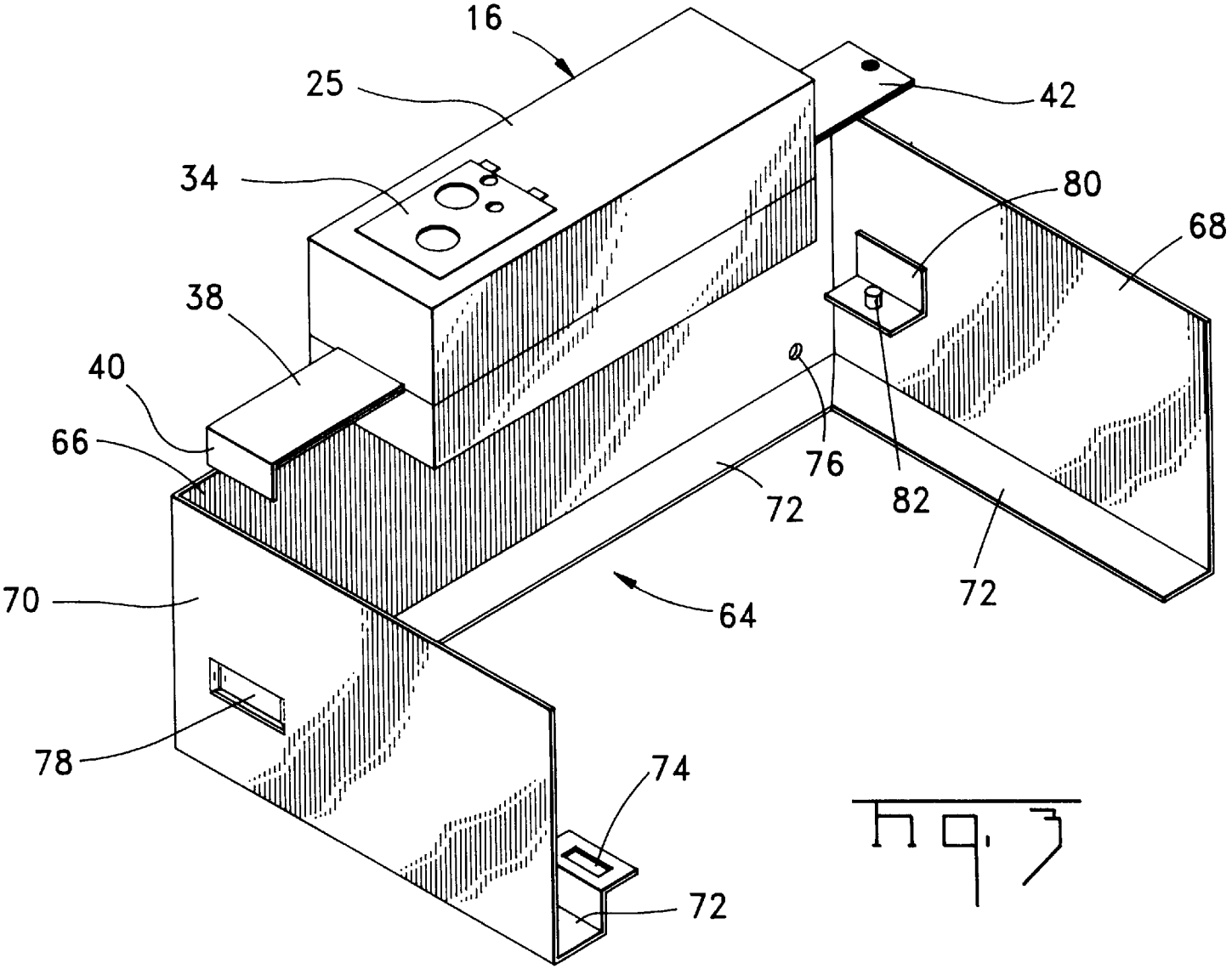
FIG. 7 is a block diagram of the components of the ballast circuitry employed in the preferred embodiment showing the manner in which four fluorescent lamps can be connected to this electronic ballast.
Figure 8:
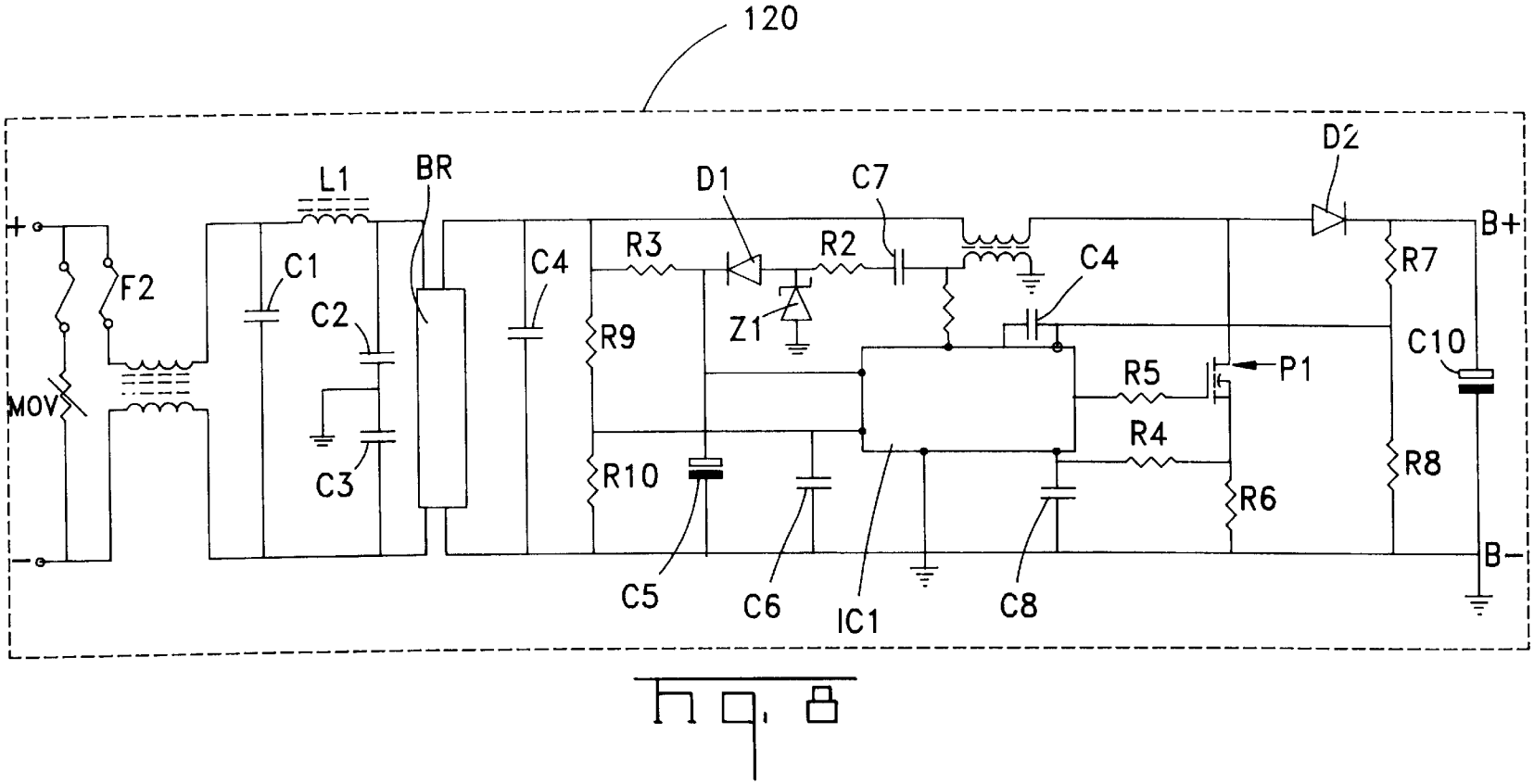
FIG. 8 is a schematic of a power supply circuit employed in the electronic ballast employed in the preferred embodiment of this invention.
Figure 9:
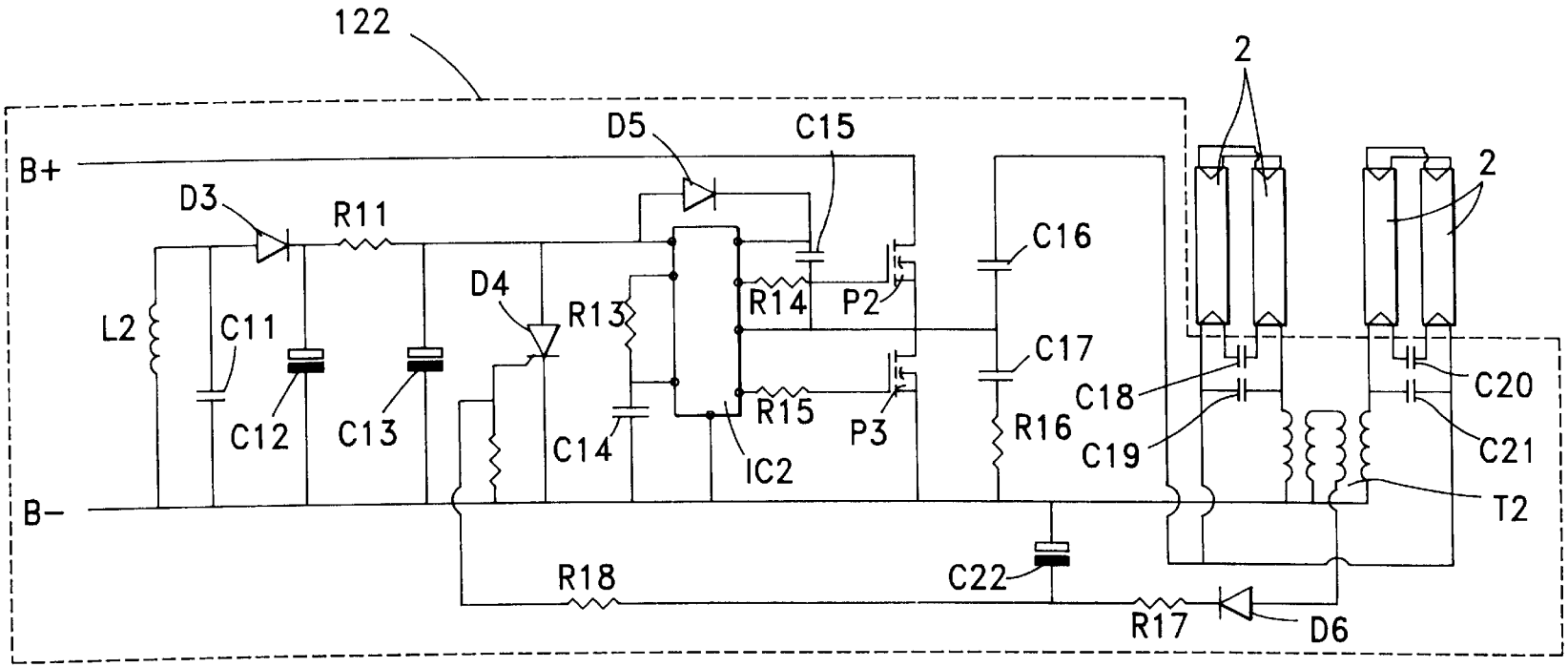
FIG. 9 is a view of the ballast circuit employed in the electronic ballast used in the preferred embodiment of this invention.

The outer housing 16 is divided into two internal compartments 28, 30 by an internal divider wall 32. Electronic ballast circuitry shown in FIGS. 7–9 is located in the first compartment 28. The electronic ballast circuitry is mounted on a printed circuit board 118 that is mounted in the first compartment 28. Conventional fluorescent lamp sockets 58 are either mounted directly on the printed circuit board 118 or are connected by leads (not shown) that do not enter the second compartment 30. The sockets 58 are mechanically secured on the ballast subassembly by socket clips 56 that are located on the lower surface of the ballast housing base 46 (shown inverted in FIG. 2). These fluorescent lamp sockets 58 are otherwise conventional and are of the type that permit a bipin fluorescent lamp to be rolled into the socket in a conventional manner.

The second housing compartment 30 provides space for electrical conductors that can be connected to a source of electrical power, such as a 120 VAC or 277 VAC electrical power source. Sufficient space is also provided in compartment 30 for conventional twist-on connectors or wire nuts or other conventional connectors to connect the leads to the building power wiring. Second compartment 30 thus serves as an integral junction box. The internal wall 32 provides sufficient separation between class 1 wiring and class 2 wiring as provided by applicable codes. An access plate 34, identical to that used on conventional fluorescent lighting troffers, is clipped to the outer surface 23 of housing body 26 in the second compartment 30. Access ports 36 provide space for the building wiring (not shown) to enter the second compartment 30. These ports are also sufficient to permit the use of flexible metal conduit or plastic conduit where required or permitted by applicable codes.

Ballast housing 16 also includes a first mounting arm 38 extending from the first end face 18 and a second mounting arm 42 extending from the opposite second end face 20. The first mounting arm 38 has a right angle arm mounting tab 40 extending from the end thereof spaced from the housing face 18. This tab 40 extends downward when the ballast housing 16 is mounted in the lighting fixture 12 as shown in FIG. 1, or upward in the inverted view of FIG. 2. The second mounting arm 42 includes a hole 44 that has a diameter sufficient to receive a pin 82 located on the first end support 64. Mounting arms 38, 42 support the ballast housing 16 in the proper position when the tab 40 engages a slot 78 on the end support 64 and when the hole 44 is positioned above the pin 82 also on the end support 64. The housing base 46 also includes arms 52 and 54 that extend from opposite ends and which can be fastened to companion mounting arms 38, 42 to secure the housing base 46 to the housing body 26.

The ballast housing 16 is mounted on the first end support 64 in the embodiment depicted in FIG. 1. As shown in more detail in FIG. 3, end support 64 comprises a C-shaped sheet metal member including an end panel 66, a first side panel 68 and a second side panel 70. The inner side of the end support 64 is open. The embodiment of the end support 64 shown in FIGS. 1 and 3 is intended to be mounted on the structure on which the lighting fixture 12 is to be mounted. For the embodiment shown, this structure is the suspended ceiling 4 and more particularly the T-bars 6. The end panel 66 and the side panels 68 and 70 each include an inwardly facing ledge 72 along the bottom edge as shown in FIG. 3. This ledge 72 is dimensioned to rest on the horizontal surface of companion T-bars around the periphery of the opening 10 in which the lighting fixture 12 is to be mounted. In this embodiment, the side panels 68 and 70 do not extend the length of the opening 10 because the side panels are intended only to provide support and stability to the ballast subassembly 14 and not to enclose the sides of the lighting fixture 12. The ledge or flange 72 on the side panel 70 includes an extension containing a slot 74. This slot 74 is intended to receive a latch finger on a conventional rotating diffuser panel latch 116. The end panel 66 includes a hole 76 adjacent to side panel 68. A diffuser panel mounting pin 114 is to be received in hole 76 to permit the diffuser panel to rotate about pin 114 and to be secured by a latch 116 received within slot 74.

Side wall 70 also includes a slot 78 that can be formed by shearing and then stamping a portion of the sidewall 70. Slot 78 opens upwardly as shown in FIGS. 1 and 3 and is dimensioned to receive the mounting tab 40 on ballast housing mounting arm 38. An angled support ledge 80 is secured to the inner face of side panel 68 by welding or other means and an upwardly facing pin 82 is mounted on the upper surface of the angled section 80. This pin 82 is positioned for receipt through hole 44 on ballast mounting arm 42 when the ballast housing 16 is mounted on the end support 64. The ballast housing 16 can be assembled on end support 64 by first aligning the hole 44 with pin 82 and then by rotating the ballast housing until the tab 40 is inserted into the slot 78. Advantageously tab 40 forms a tight fit in slot 78 so that a continuous electrical ground is maintained between the ballast housing 16 and the end support 64 that is in turn grounded to the T-bar 6 on which it sits. However this fit should not prevent removal of tab 40 when the ballast is to be replaced.

Figure 4:
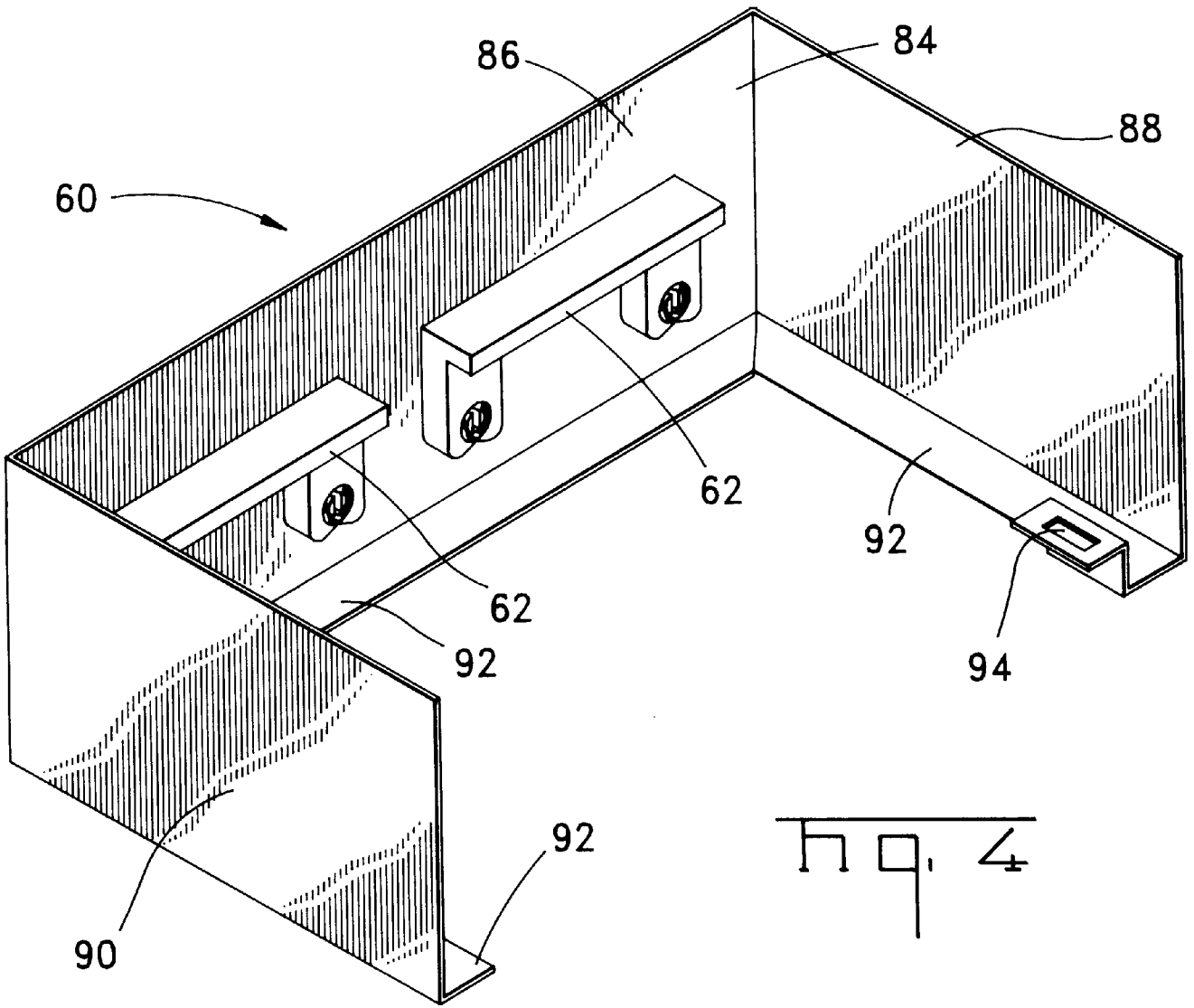
FIG. 4 is a perspective view of commoning lamp sockets mounted on an end support that would be mounted at the opposite end of an opening in a suspended ceiling from the end support shown in FIG. 3.

The second end support 84 shown in FIG. 4 also comprises a C-shaped sheet metal member including an end panel 86, a first side panel 88 and a second side panel 90. Flange 92 is formed on the lower edges of panel 86, 88, 90 to permit the second end support 84 to be mounted on suspended ceiling T-bars 6 in the same manner as the first end support 64. A diffuser panel latch 94 is also provided on the flange 92 extending from side panel 88 and a hole (not shown) is provided adjacent the opposite side of end panel 86 so that the second end of the diffuser panel 110 can be rotatably secured to the second end support 84 in the same manner in which it is secured to the first end support 64.

The second end support 84 is intended to support a socket subassembly 60 including commoning fluorescent lamp sockets 62 that can be snap fit onto the end panel 86 by conventional means. The preferred embodiment of the lighting fixture 12 shown in FIGS. 1–5 is a four lamp fixture and two commoning sockets 62 are employed. Each commoning socket is intended to common the pins of two four foot instant start T-8 bipin fluorescent lamps that are connected in series and are energized by the electronic ballast connected to the other end of each pair of tubular fluorescent lamps. As will be discussed with reference to FIGS. 7–9, the electronic ballast used in ballast subassembly 14 is capable of energizing two fluorescent lamps connected in series without any external electrical connection between the ballast and the end of the lamps 2 received in the commoning sockets 62. Therefore, no connecting wires are needed between O the ends of this lighting fixture 12, and the two end supports 64 and 84 can be independent members that can be separately mounted on, or detached from, the opposite sides of the opening 10 in which the lighting fixture 12 is mounted.

Figure 5:
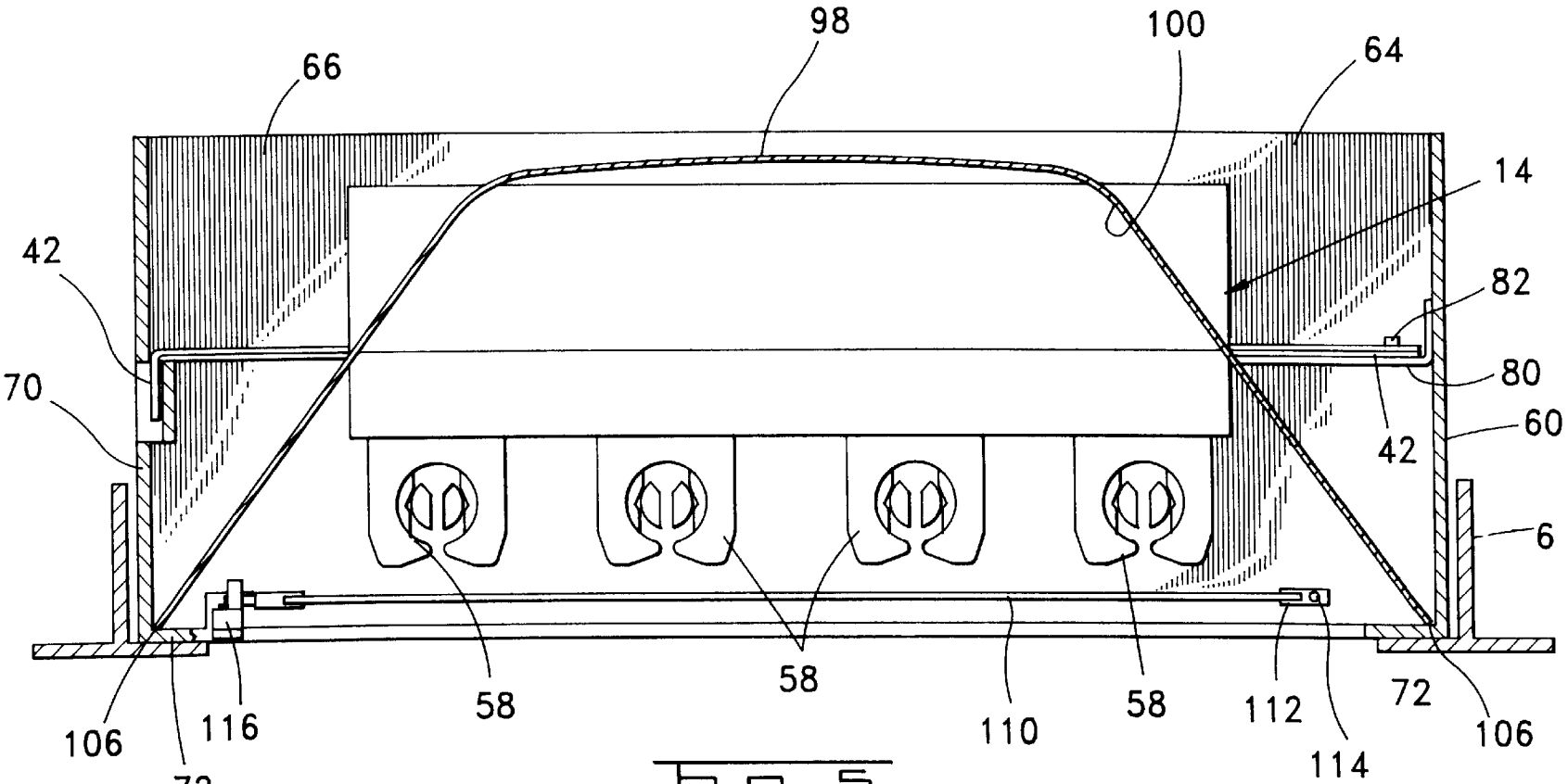
FIG. 5 is a side view of the integral ballast and the end support shown in FIG. 3, showing the addition of a bonnet or hood on the top of the lighting fixture and a pivotal diffuser panel mounted below the lamp sockets in which the tubular fluorescent lamps would be mounted.

FIG. 5 shows the way in which the bonnet 98 and the diffuser panel 110 are mounted on the lighting fixture 12. The diffuser panel 110 comprises a thin translucent panel that is used to filter the light from the fluorescent lamps 2 and to reduce glare. As in a conventional lighting fixture, the diffuser panel 110 is mounted in a surrounding sheet metal frame 112 with a pivot pin 114 extending from each end of the diffuser panel frame 114 along one side of the frame. Two diffuser panel latches 116 are attached to the other side of the frame 114 by a rivet that allows the latch 116 to rotate relative to the plane of the panel 110. This latch 116 is of conventional construction and includes a finger (not shown) that is dimensioned to be received in the latch slots 74 and 94 on the first and second end supports.

Figure 6:
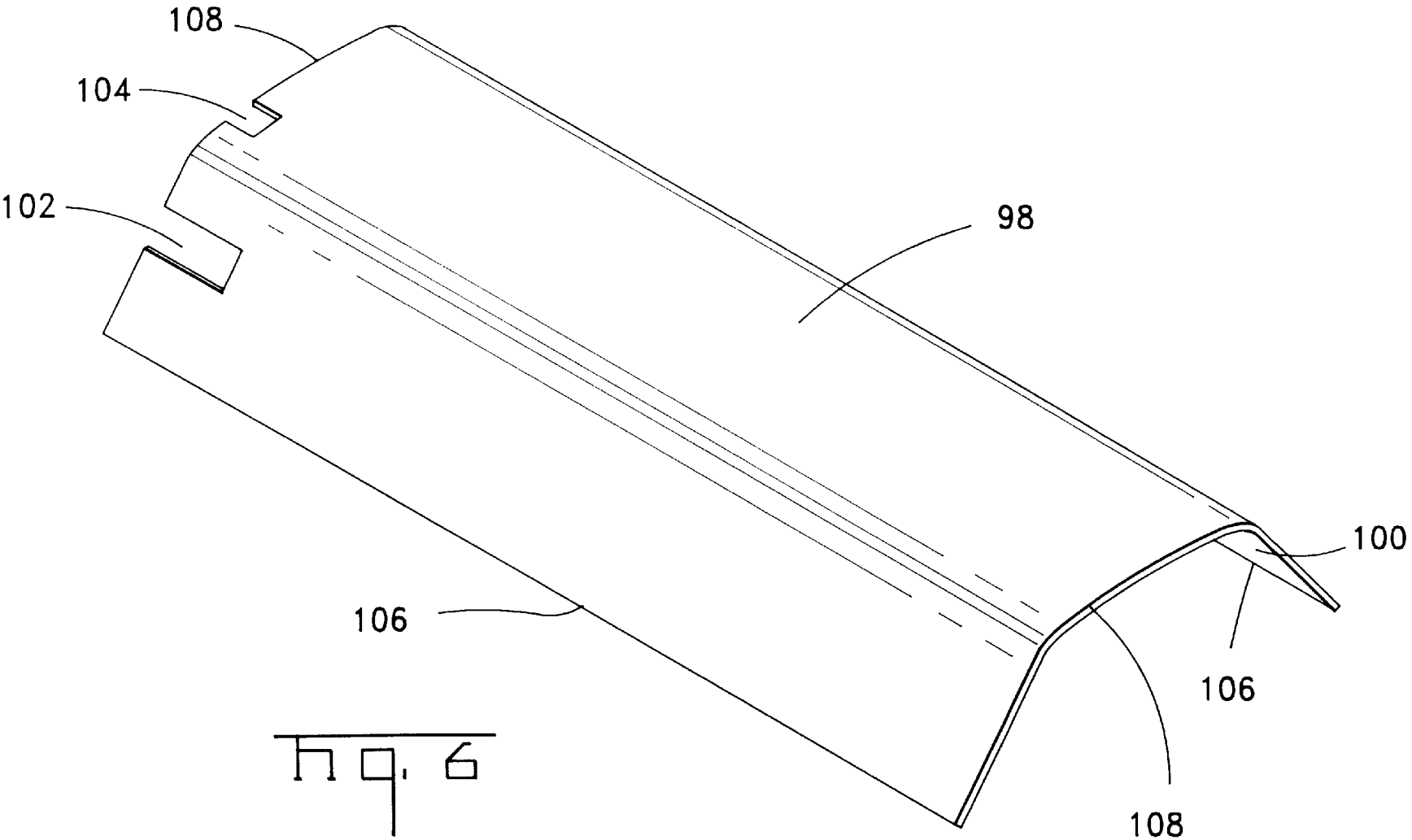
FIG. 6 is a view of the bonnet or hood used as a reflective surface on the top of the lighting fixture.
Figure 7:
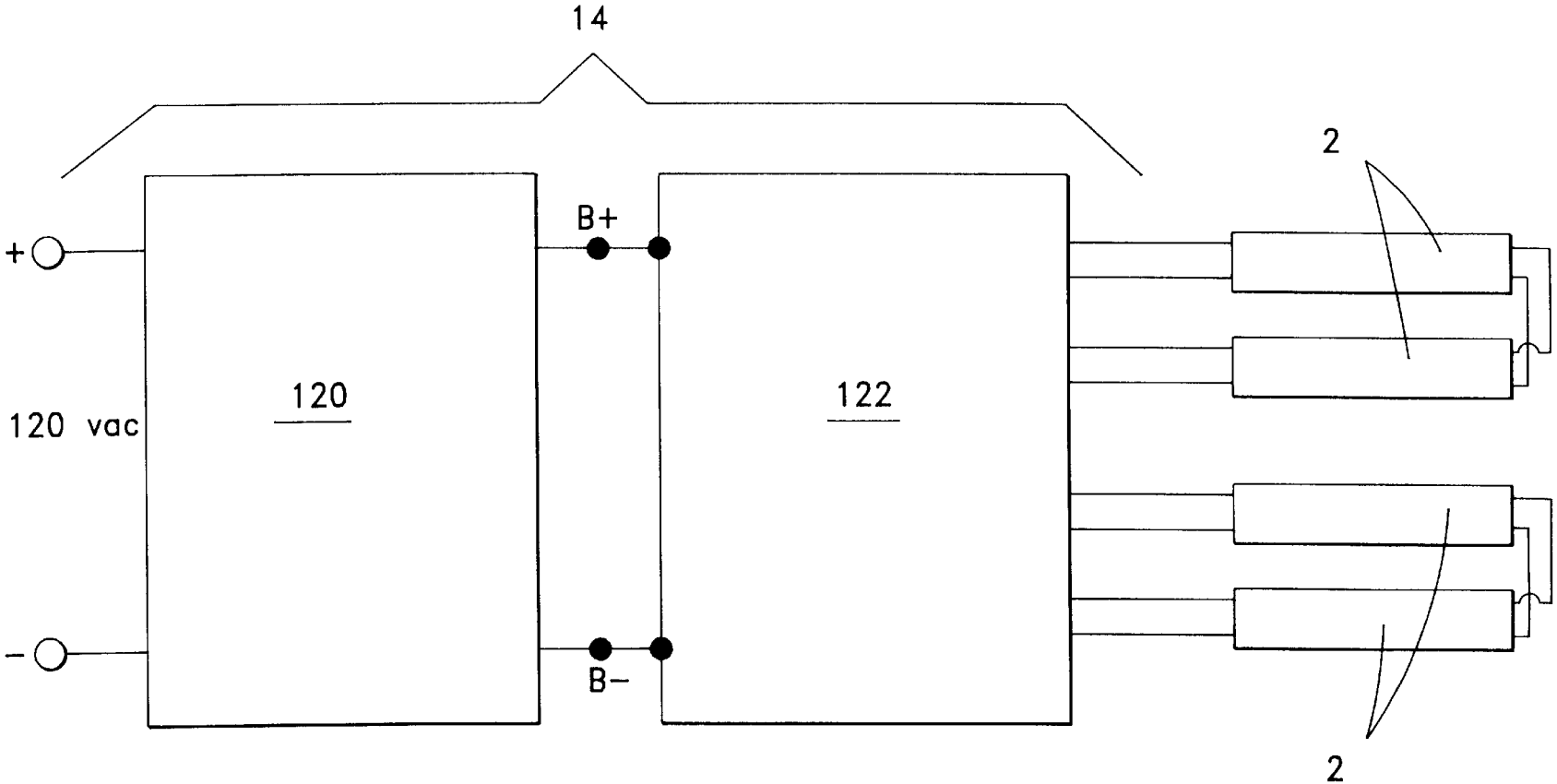

The diffuser panel 110 can be attached to the first and second end supports 64 and 84 either before or after the bonnet or hood 98 is mounted in the lighting fixture 12. The bonnet or hood 98 is however inserted into place before tubular fluorescent lamps 2 are positioned in aligned sockets 58 and 62. Bonnet or hood 98 can be inserted through the opening 10 in a suspended ceiling and between the end supports 64 and 84 previously positioned at opposite ends of a suspended ceiling opening 10. Sufficient space is available to permit insertion of bonnet or hood 98 at an angle through opening 10. The bonnet or hood 98 can then be realigned and dropped into position with the longitudinal edges 106 fitting at the inside juncture between flange 72 and side panels 68 and 70 on one end and flange 92 and panels 88 and 90 at the other end. The longitudinal edges 106 of the bonnet or hood 98 can also be supported at the intersection between the vertical and horizontal sections of suspended ceiling T-bars 6. Bonnet or hood 98 can also be constructed of a flexible material to further simplify insertion between end supports 64 and 84. The inner surface 100 of bonnet or hood 98 is reflective so that light emitted by the fluorescent lamps 2 can be redirected to illuminate the intended area below the suspended ceiling 4. As shown in FIG. 5 the upper surface of the bonnet or hood 98 is located below the top of the end panel 66 so that light is trapped and is not emitted into the area above the suspended ceiling. As shown in FIG. 6 one end of the bonnet or hood 98 includes a first cutout section 102 so that the bonnet or hood 98 can be fitted over the ballast subassembly 14. An additional cutout 104 provides room for the building wiring exiting from the access holes 36 on the top of the ballast housing 16.

The ballast subassembly 14 used in the preferred embodiment of this invention includes an electronic ballast circuit that is capable of energizing two four foot T-8 fluorescent lamps 2 connected in series when the electronic ballast is connected only to one end of the two lamps forming a pair. For a four lamp lighting fixture, the ballast circuit would be connected to adjacent ends of the two lamps in each pair. The electronic ballast and the power supply circuit 120 and ballast circuit 122 used in the representative embodiments of this invention are shown in FIGS. 7–9. This electronic ballast is commercially available and is manufactured and sold as the MULTILITE MUL120 ballast by Electrofab, Ltd. This ballast is capable of operating two eight-foot instant start fluorescent lamps or four lamps in two pairs. Component values and component designations are listed in the following table.

| ELECTRONIC BALLAST COMPONENTS | |
|---|---|
| C1 | 250 V |
| C2 | 5000 pF 2 KV |
| C3 | 5000 pF 2 KV |
| C4 | 1 ☞ F 250 V |
| C5 | 22 ☞ F 25 V |
| C6 | 10 nF |
| C7 | 10 nF |
| C8 | 1 nF |
| C9 | 330 nF |
| C10 | 150 ☞ F 385 V |
| C11 | 5000 pF |
| C12 | 22 ☞ F 63 V |
| C13 | 47 ☞ F 25 V |
| C14 | 0.001 ☞ F |
| C15 | 0.1 ☞ F |
| C16 | 1 ☞ F 400 V |
| C17 | 0.001 ☞ F 600 V |
| C18 | 1 nF |
| C19 | 5.6 nF |
| C20 | 5.6 nF 1000 V |
| C21 | 1 nF |
| C22 | 100 ☞ F 50 V |
| R1 | 68 KOHMS |
| R2 | 100 OHMS |
| R3 | 68 KOHMS |
| R4 | 330 OHMS |
| R5 | 10 OHMS |
| R6 | 0.33 OHMS 1 W |
| R7 | 1.5 MOHMS 1% |
| R8 | 5.76 KOHMS |
| R9 | 1.5 MOHMS 1% |
| R10 | 15 KOHMS 1% |
| R11 | 1.3 KOHMS |
| R12 | 330 OHMS |
| R13 | 22 KOHMS |
| R14 | 22 OHMS |
| R15 | 22 OHMS |
| R16 | 10 OHMS |
| R17 | 220 OHMS |
| R18 | 4.7 KOHMS |
| D1 | 1N4148 |
| D2 | 31KF4 |
| D3 | MUR 130 |
| D4 | S2261 |
| D5 | 11DF4 |
| Z1 | 1N52488 |
| BR | BRIDGE RECTIFIER KBL10 |
| IC1 | SGS-THOMSON L6560 |
| IC2 | INTERNATIONAL RECTIFIER IR1251 |

Figure 10:
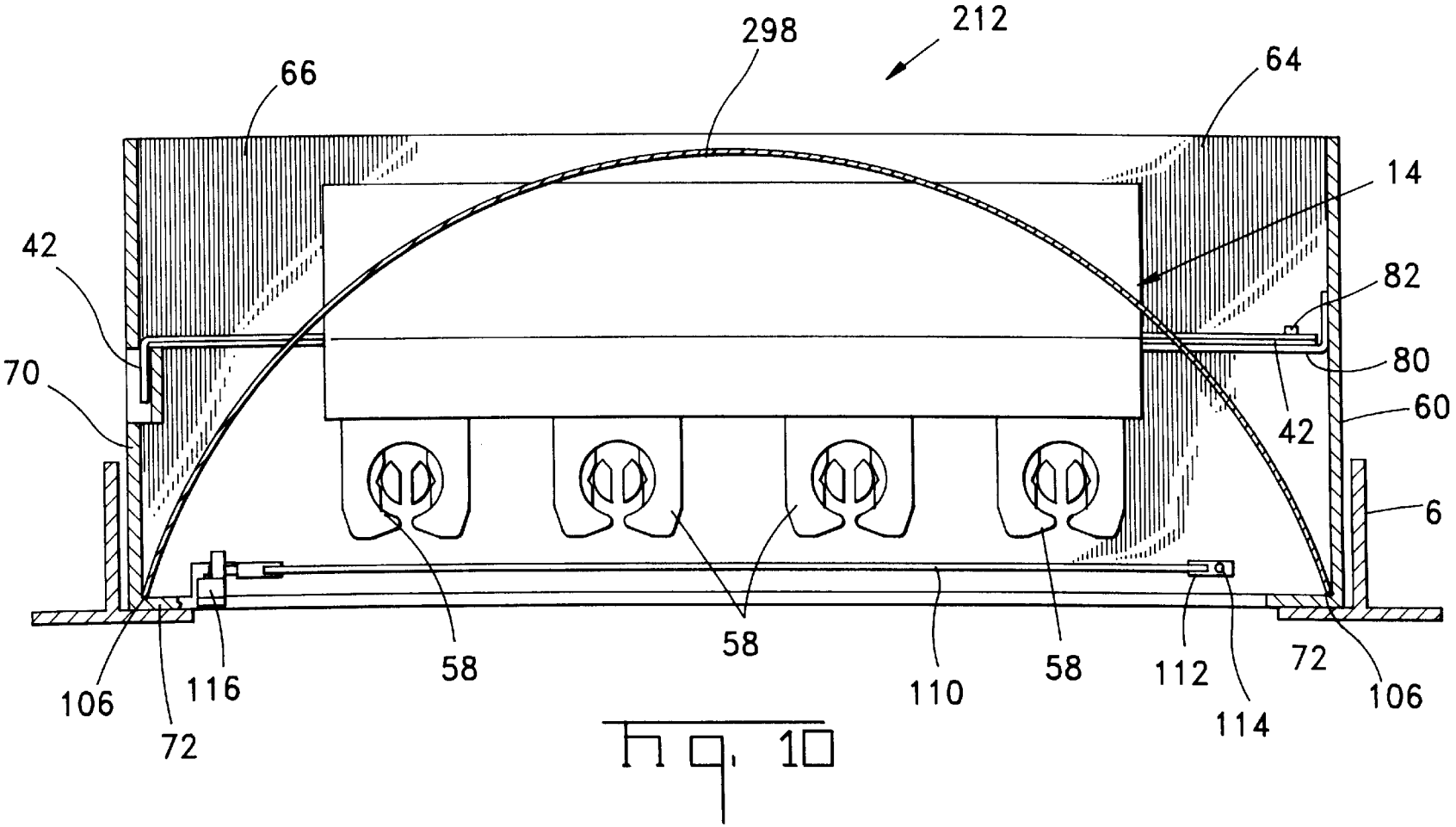
FIG. 10 is a view of an alternate embodiment in which a thin flexible flat sheet metal bonnet or hood is flexed into a curved or parabolic configuration on the top of the lighting fixture.

A first alternate embodiment of this invention is shown in FIG. 10. The lighting fixture 212 shown in FIG. 10 is in most respects the same as the lighting fixture 12 shown in FIGS. 1–5. This first alternate embodiment of the lighting fixture 212 however uses a bonnet or hood 298 that is formed from a thin, flexible sheet metal member that can be shipped in a substantially flat configuration. A number of bonnets 298 can be stacked and shipped in the same rectangular container. Since the metal bonnet 298 is flexible, it can be assembled by pressing the two longitudinal edges together and then fitting them into engagement with end supports in a similar manner to the angled bonnet 98 used in the embodiment of FIGS. 1–6. Flexible bonnet 298 will however assume a curved configuration after it has been fitted between opposite end supports. This curved configuration has an additional advantage. Light from the lamps located within the convex curvature of the bonnet or hood 298 will be dispersed in an efficient manner due to the curved shape of this hood. The curved hood 298 can also be formed so that it will assume a prescribed curvature when inserted in the manner shown in FIG. 10. For example the hood 298 could be constructed to assume a parabolic curvature.

Figure 11:
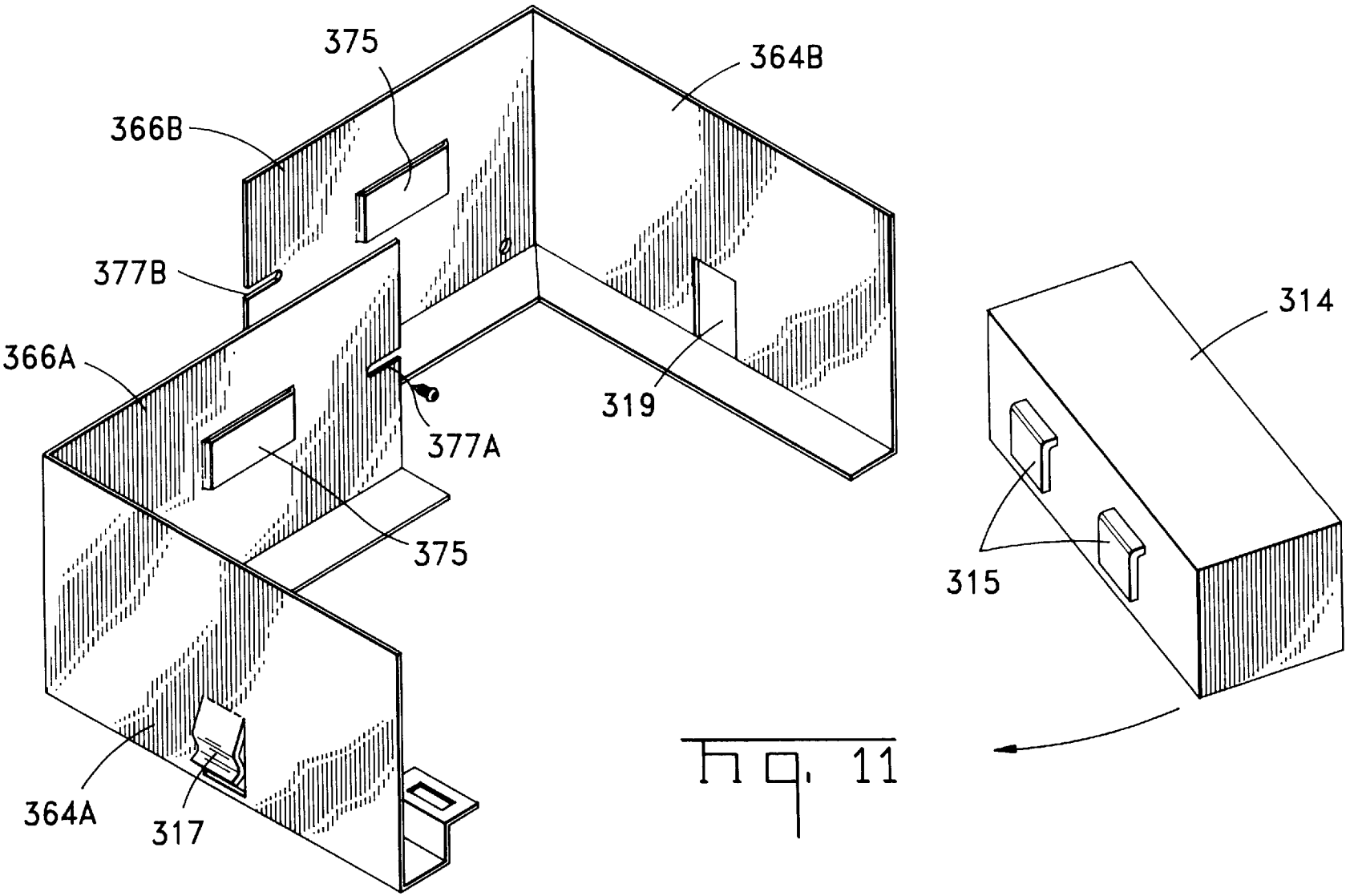
FIG. 11 is a view of an alternate embodiment showing an adjustable ballast support that can be used in openings of different or nonstandard sizes.

FIG. 11 shows a second alternate embodiment of this invention. An end support 364 that would be used to mount ballast subassembly 314 is shown in FIG. 11. This end support 364 comprises two separate adjustable end support sections 364A and 364B that can be relatively telescoped and secured together so that they can be fitted in openings of different sizes. Each end support 364A and 364B has an end panel 366A and 366B respectively that has a length of slightly more than half the length of end panel 66. Aligned slots 377A and 377B provide space for a fastener to be inserted through the slots to secure the two end supports 364A and 364B together so that the separation of the side panels 368 and 370 is equal to the width of the opening in which the adjustable end support is to be mounted. End panels 366A and 366B also have slots 375 formed in the metal for receiving tabs 315 that can be located along the back surface of a ballast subassembly 314 that are used instead of the side arms 38 and 42. Similar slots could be used on the embodiment of FIGS. 1–5 that did not include the adjustable feature. An adjustable lamp socket end support containing similar features to those shown in FIG. 11 would be used with adjustable end supports 364A and 364B. FIG. 11 also shows the use of an integral grounding clip 317 on end support 364A. This grounding clip 317 is formed out of the plane of the sidewall of support 364A and formed to be spring biased. A clearance opening 319 is provided in end support 364B for installations in which two lighting fixtures are placed side by side. With this embodiment, the fastener connecting end supports 364A and 364B will common both supports at ground potential. An integral grounding clip could also be used with the other embodiments of the end supports. An integral grounding clip and a corresponding clearance opening could also be positioned on the end panel of an end support, and two lighting fixtures could be positioned end to end. It should also be noted that the flexible hood 298 shown in FIG. 10 would be especially suitable for use with adjustable end supports because the same flexible hood 298 could be used for a range of opening dimensions, of course with the resultant change in curvature of the installed hood. These end supports 364A and 364B can be nested for shipment.

Figure 12:
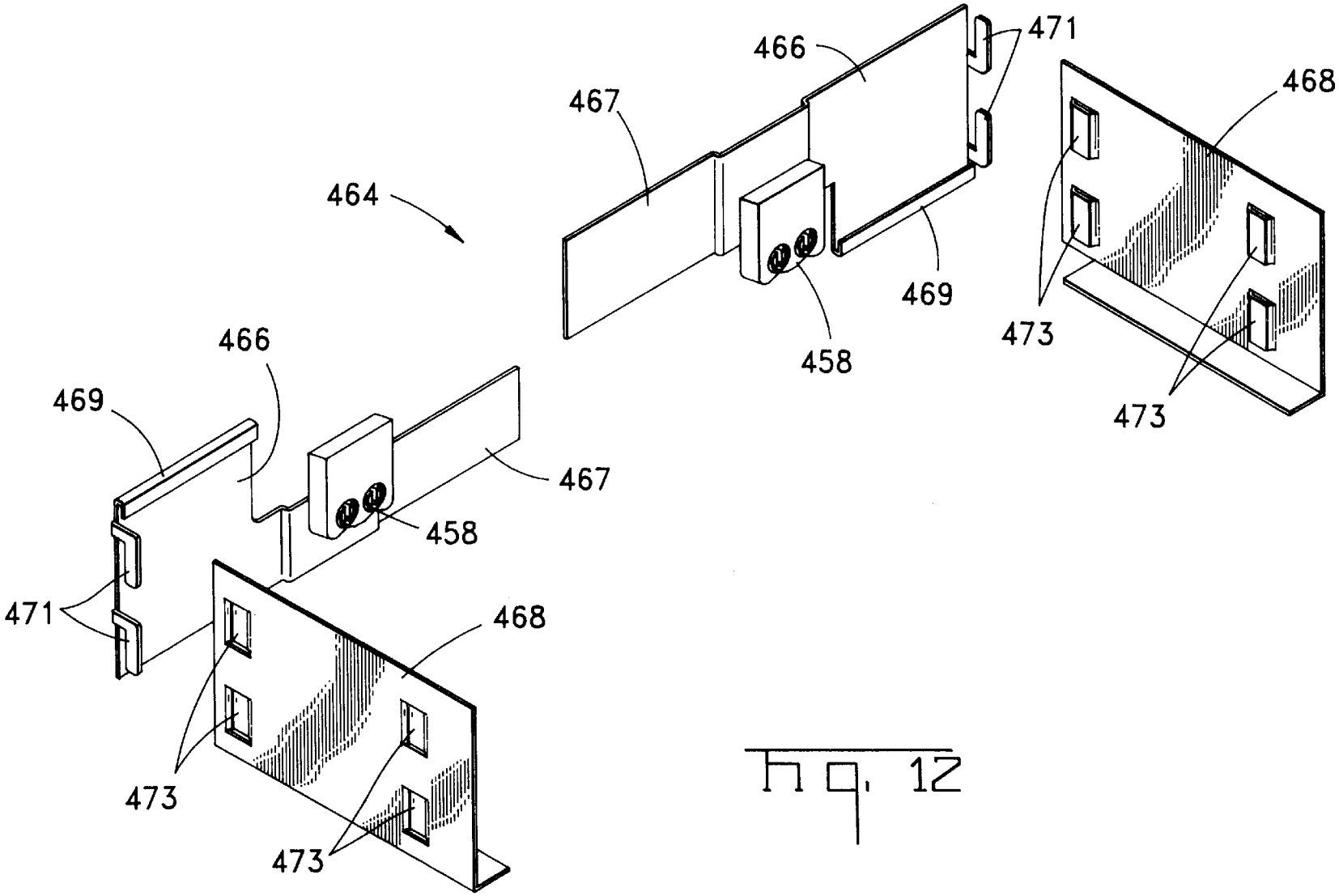
FIG. 12 is another alternate embodiment, showing an adjustable commoning socket support that also employs generally flat hermaphroditic sections that can be assembled on site.
Figure 17:
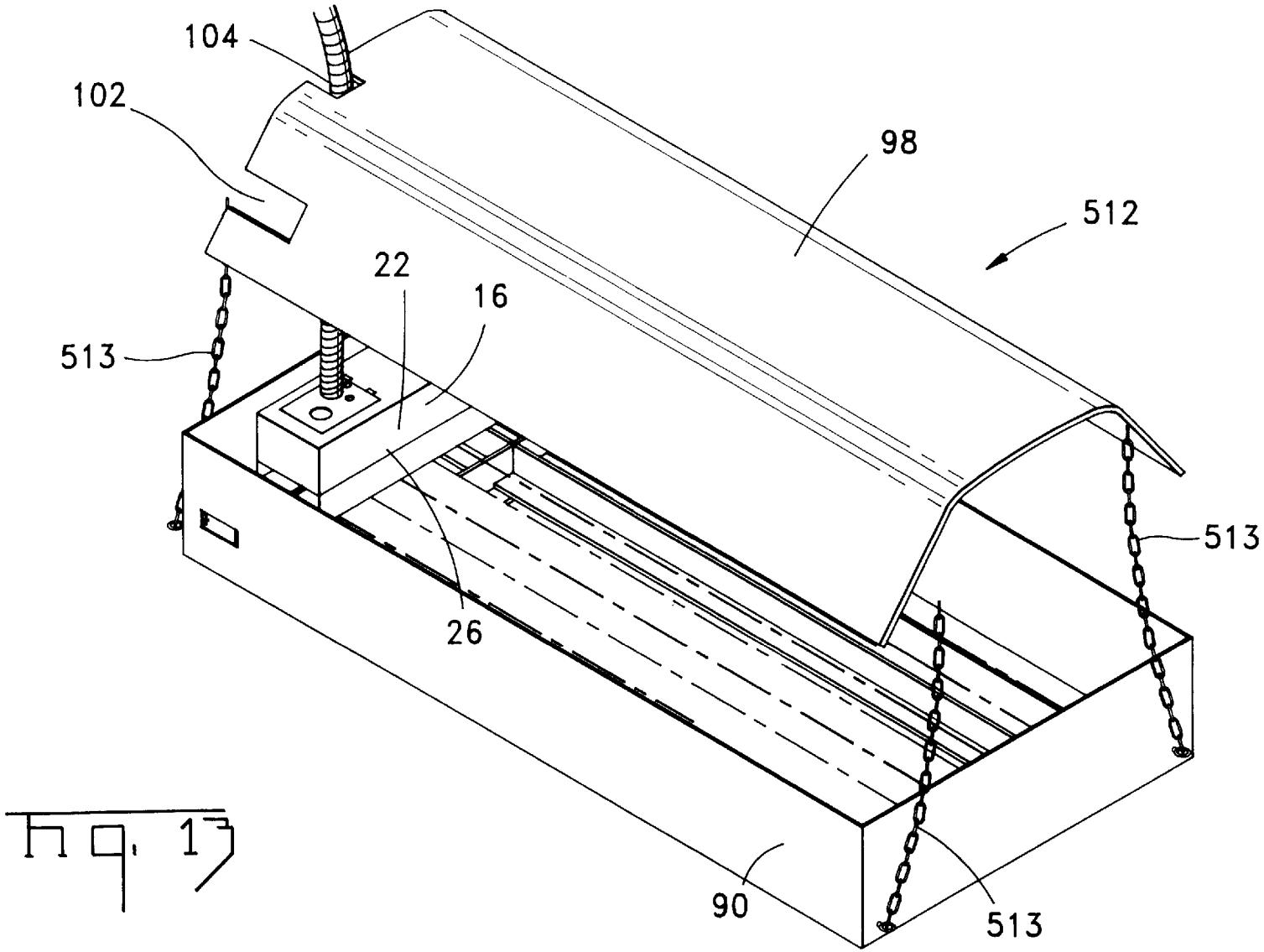

FIG. 12 shows a third alternate embodiment in which the end support 464 is not only adjustable, but uses hermaphroditic parts and can also be shipped in a substantially flat configuration. End support 464 is formed from two identical end panels 466 and two identical side panels 468. Each of the end panels 466 includes an arm 467 having a height of one half of the height of the end panel 466. The full height portion of the end panel 466 includes a lip 469 that forms a channel in which an arm 467 from the opposite hermaphroditic end panel 467 can be inserted. The arms 467 are offset relative to the remainder of the end panel 466 by a distance substantially equal to the thickness of the panel so that the arms 467 will fit beneath the lip 469. Lamp sockets 458 can be snapped onto the arms 467 with the centerlines of the sockets 458 being aligned. Detents or fasteners can be provided to secure the telescoping end panels 466 together so that the end support 466 will have the proper width. The end panels 466 also have integral mounting tabs 471 extending perpendicular to the panels 466 on one end. These mounting tabs 471 can be fitted into slots 473 formed outwardly from the plane of side panels 468. Slots 473 are provided along opposite sides of the side panel 468 so that the same side panel can be used on opposite sides of the end support 464 to reduce the number of separate parts that must be manufactured.

FIG. 13 shows another embodiment in which the lighting fixture 512 is to be suspended below a ceiling by chains 513 instead of being mounted in a suspended ceiling. This suspended version uses the same bonnet or hood 98 used with the embodiment of FIGS. 1–5. The flexible flat panel bonnet 298 used in the embodiment of FIG. 10 could also be used in this suspended version. This suspended fixture 512 uses a continuous frame 515 instead of the two separate end supports 64, 84 used in the embodiment of FIGS. 1–6 and the other similar embodiments. In an alternate suspended version, the tops of the separate end supports 64, 84 could be attached directly to the ceiling.

The representative embodiments described in detail herein show only some of the various structures that employ the invention claimed herein. Other embodiments, not shown in detail would be equivalent to those described herein. For example the ballast subassembly and the commoning socket subassembly could include mounting members as integral components. These integral mounting components could engage the

We claim:

1. A lighting fixture for use with fluorescent lamps comprising:

first and second end supports;

a ballast subassembly mounted on the first end support, the ballast subassembly including an electrically conductive outer housing having a first compartment containing a ballast circuit and a second compartment separated from the first compartment by an internal wall, conductors for attaching the ballast subassembly to an external source of electrical power emerging from the second compartment, and lamp sockets;

lamp sockets mounted on the second end support; and a hood positioned above the lamp sockets and extending between and supported by the first and second end supports, the hood including an inner surface reflecting light emitted by fluorescent lamps positioned in the lighting fixture and extending between lamp sockets at opposite ends of the lighting fixture.

2. The lighting fixture of claim 1 wherein the hood is also positioned above the ballast subassembly.

3. The lighting fixture of claim 1 wherein the first and second end supports are detached members.

4. The lighting fixture of claim 3 wherein the first and second end supports each include separate mounting means for independently mounting each end support on a structure on which the fixture is to be mounted.

5. The lighting fixture of claim 4 wherein the hood is detachable from the end supports and is mounted on the end supports after the end supports are mounted on the structure on which the fixture is to be mounted.

6. The lighting fixture of claim 1 wherein the first and second end supports are configured to mount on a frame of a suspended ceiling.

7. The lighting fixture of claim 1 wherein the ballast subassembly is detachably mounted on the first end support so that the ballast subassembly can be replaced without removal of the end supports.

8. The lighting fixture of claim 1 wherein the first end support includes first and second opposed side panels joined by an end panel to form a C-shaped member.

9. The lighting fixture of claim 8 wherein the ballast subassembly is detachably mounted on the opposed side panels.

10. The lighting fixture of claim 8 wherein flange means are located at the bottom of the first end support, the flange means being configured for mounting the first end support on T-bars comprising a portion of a frame of a suspended ceiling.

11. The lighting fixture of claim 10 wherein the hood is supported by the flange means.

12. The lighting fixture of claim 1 wherein the ballast subassembly includes an electronic ballast capable of energizing at least two fluorescent lamps connected in series with the electronic ballast being connected to only one end of each of the two fluorescent lamps.

13. The lighting fixture of claim 1 wherein the hood comprises a flexible member.

14. The lighting fixture of claim 1 wherein the hood has a curved cross section when mounted between the two end supports.

15. The lighting fixture of claim 1 wherein the first and second end supports each include an integral grounding clip, each grounding clip protruding from an end support to engage a T-bar on a suspended ceiling on which the lighting fixture is mounted.

16. The lighting fixture of claim 1 wherein each of the first and the second end supports comprises two end support sections and fastening means for securing the end support sections together in different positions such that a width of each of the first and the second end supports is adjustable, whereby common end support sections can be used for lighting fixtures having different widths.

17. An assembly for mounting an electronic ballast in a fluorescent lighting fixture, the assembly comprising:

an electrically conductive outer housing having first and second compartments separated by a divider wall, an electronic ballast circuit being positioned in the first compartment, leads for connecting the ballast circuit to an external source of electrical power extending through the divider wall into the second compartment, the second compartment having sufficient space for the leads and for connection of the leads to building wiring entering the second compartment, the assembly also including fluorescent lamp sockets mounted on an exterior face of the housing and mounting members on the exterior of the housing for mounting the assembly in a fluorescent lighting fixture.

18. A lighting fixture for use in a ceiling having a frame defining an opening, the lighting fixture comprising:

first and second end supports each including opposed side panels joined by an end panel, each of the side panels having a ledge along a bottom thereof, the ledges being configured to rest on the frame such that the first and the second end supports can be independently mounted on the frame at respective opposite ends of the opening;

a ballast subassembly mounted on the first end support, the ballast subassembly including lamp sockets;

lamp sockets mounted on the second end support; and a hood which is insertable upwardly through the opening after the first and the second end supports have been mounted on the frame, the hood then being lowerable for engagement with the ledges of the first and the second end supports such that the hood is removably supported on the ledges.

19. The lighting fixture of claim 18 wherein the hood is a flexible member.

20. The lighting fixture of claim 18 wherein the hood has a curved configuration as it extends between the opposed side panels of one of the first and the second end supports.

21. The lighting fixture of claim 18 wherein the ballast subassembly comprises an electrically conductive outer housing having a first compartment containing a ballast circuit and a second compartment separated from the first compartment by an internal wall, and conductors for attaching the ballast subassembly to an external source of electrical power emerging from the second compartment.

22. The lighting fixture of claim 18 wherein each of the first and the second end supports comprises two end support sections and fastening means for securing the end support sections together in different positions such that a width of each end support is adjustable, whereby common end support sections can be utilized in lighting fixtures having different widths.

* * * * *